US010095177B2

(12) United States Patent
Ninomiya et al.

(10) Patent No.: US 10,095,177 B2
(45) Date of Patent: Oct. 9, 2018

(54) CLEANER INCLUDING A TRANSPORT MEMBER CONFIGURED TO TRANSPORT DEVELOPER

(71) Applicant: FUJI XEROX CO., LTD., Tokyo (JP)

(72) Inventors: Yosuke Ninomiya, Kanagawa (JP); Mikio Yamaguchi, Kanagawa (JP); Hiroyuki Mamiya, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/446,151

(22) Filed: Mar. 1, 2017

(65) Prior Publication Data

US 2018/0088519 A1 Mar. 29, 2018

(30) Foreign Application Priority Data

Sep. 29, 2016 (JP) ..... 2016-192132

(51) Int. Cl.
*G03G 21/10* (2006.01)
*G03G 21/00* (2006.01)

(52) U.S. Cl.
CPC ..... *G03G 21/0029* (2013.01); *G03G 21/105* (2013.01)

(58) Field of Classification Search
CPC .. G03G 21/0029; G03G 21/105; G03G 21/10; G03G 2221/0005
See application file for complete search history.

(56) References Cited

U.S. PATENT DOCUMENTS 4,685,798 A * 8/1987 Matsumoto ..... G03G 21/105 15/256.51
8,942,601 B2 * 1/2015 Fujii ..... G03G 15/0832 399/254
2004/0258441 A1 12/2004 Park et al.
(Continued)

FOREIGN PATENT DOCUMENTS

JP 07325521 A * 12/1995
JP 2005-10751 A 1/2005
(Continued)

*Primary Examiner* — David M Gray
*Assistant Examiner* — Laura Roth
(74) *Attorney, Agent, or Firm* — Sughrue Mion, PLLC

(57) ABSTRACT

A cleaning unit includes a cleaning member, an accommodating portion, and a transport member. The cleaning member removes a developer from a surface of an image carrier. The accommodating portion accommodates the removed developer. The transport member transports the developer removed by the cleaning member to the accommodating portion. The transport member includes a shaft member and first and second transport bodies. The shaft member extends in a direction intersecting a transport direction of the developer. The first transport body is rotatably supported by the shaft member. The second transport body is rotatably supported by the first transport body at a position spaced from the shaft member. The second transport body extends toward the cleaning member. When the shaft member rotates, a trajectory of an end portion, at a cleaning member side, of the second transport body is an ellipse elongated along the transport direction on the cleaning member.

17 Claims, 8 Drawing Sheets

(56) References Cited

U.S. PATENT DOCUMENTS

| | | | | |
|---|---|---|---|---|
| 2006/0216083 | A1* | 9/2006 | Okoshi | G03G 21/105 399/350 |
| 2011/0182639 | A1* | 7/2011 | Kim | G03G 21/12 399/358 |
| 2017/0269537 | A1* | 9/2017 | Yamaguchi | G03G 21/0011 |

FOREIGN PATENT DOCUMENTS

| | | | | |
|---|---|---|---|---|
| JP | 2006048085 | A | * | 2/2006 |
| JP | 2009-145661 | A | | 7/2009 |
| JP | 2011-149981 | A | | 8/2011 |

* cited by examiner

CLEANER INCLUDING A TRANSPORT MEMBER CONFIGURED TO TRANSPORT DEVELOPER

CROSS-REFERENCE TO RELATED APPLICATIONS

This application is based on and claims priority under 35 USC 119 from Japanese Patent Application No. 2016-192132 filed Sep. 29, 2016.

BACKGROUND

Technical Field

The present invention relates to a cleaning unit and an image forming apparatus.

SUMMARY

According to an aspect of the invention, a cleaning unit includes a cleaning member, an accommodating portion, and a transport member. The cleaning member removes a developer from a surface of an image carrier. The accommodating portion accommodates the removed developer. The transport member transports the developer removed by the cleaning member to the accommodating portion. The transport member includes a shaft member, a first transport body, and a second transport body. The shaft member extends in a direction intersecting a transport direction of the developer. The first transport body is rotatably supported by the shaft member. The second transport body is rotatably supported by the first transport body at a position spaced from the shaft member. The second transport body extends toward the cleaning member. When the shaft member rotates, a trajectory of an end portion, at a cleaning member side, of the second transport body is an ellipse elongated along the transport direction of the developer on the cleaning member.

BRIEF DESCRIPTION OF THE DRAWINGS

Exemplary embodiments of the present invention will be described in detail based on the following figures, wherein:

FIGS. 6A to 6D are explanatory views of an operation of the transport member of Example 1, in which FIG. 6A is an explanatory view illustrating the same state as FIG. 2, FIG. 6B is an explanatory view illustrating a state in which the transport member is rotated by about 30° about a rotation axis from the state of FIG. 6A, FIG. 6C is an explanatory view illustrating a state in which the transport member is rotated by about 30° about the rotation axis from the state of FIG. 6B, and FIG. 6D is an explanatory view illustrating a state in which the transport member is rotated by about 30° about the rotation axis from the state of FIG. 6C;

FIGS. 7A to 7D are explanatory views of an operation of the transport member of Example 1, in which FIG. 7A is an explanatory view illustrating a state in which the transport member is rotated by about 30° about the rotation axis from the state of FIG. 6D, FIG. 7B is an explanatory view illustrating a state in which the transport member is rotated by about 30° about the rotation axis from the state of FIG. 7A, FIG. 7C is an explanatory view illustrating a state in which the transport member is rotated by about 30° about the rotation axis from the state of FIG. 7B, and FIG. 7D is an explanatory view illustrating a state in which the transport member is rotated by about 30° about the rotation axis from the state of FIG. 7C; and FIGS. 8A to 8D are explanatory views of an operation of the transport member of Example 1, in which FIG. 8A is an explanatory view illustrating a state in which the transport member is rotated by about 30° about the rotation axis from the state of FIG. 7D, FIG. 8B is an explanatory view illustrating a state in which the transport member is rotated by about 30° about the rotation axis from the state of FIG. 8A, FIG. 8C is an explanatory view illustrating a state in which the transport member is rotated by about 30° about the rotation axis from the state of FIG. 8B, and FIG. 8D is an explanatory view illustrating a state in which the transport member is rotated by about 30° about the rotation axis from the state of FIG. 8C.

DETAILED DESCRIPTION

Figure 1:
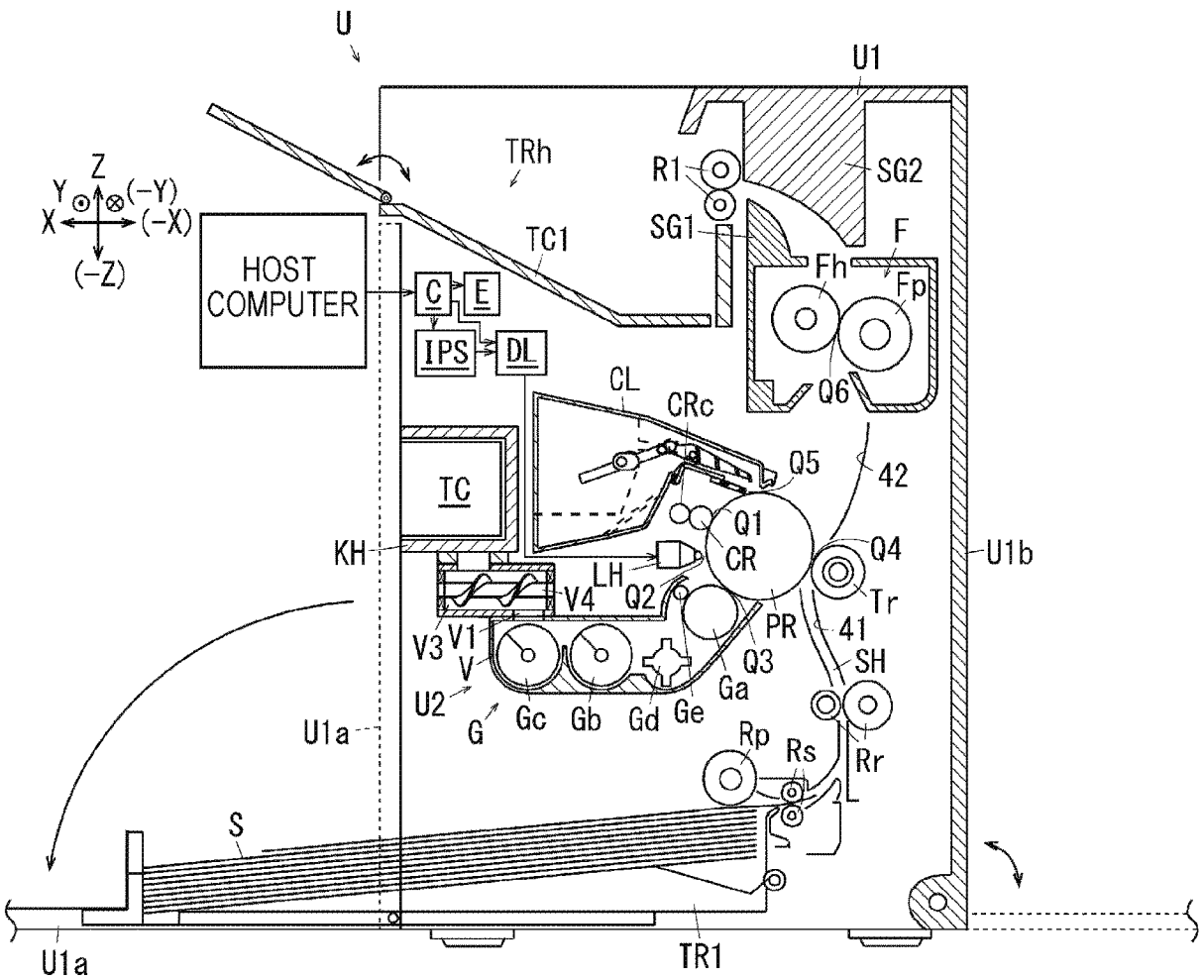
FIG. 1 is an overall explanatory view of an image forming apparatus of Example 1.

Next, examples will be described as specific examples of exemplary embodiments of the present invention with reference to the drawings, but the present invention is not limited to the examples hereinafter.

In order to facilitate the understanding of the following description, in the drawings, a front and rear direction will be referred to as an X-axis direction, a right and left direction will be referred to as a Y-axis direction, an up and down direction will be referred to as a Z-axis direction, and directions or sides indicated by arrows X, −X, Y, −Y, Z, and −Z will be referred to as forward, rearward, rightward, leftward, upward, and downward, or a front side, a rear side, a right side, a left side, an upper side, and a lower side, respectively.

In the drawings, when "•" is indicated at the center of "○", it means an arrow directed from the rear side to the front side of a drawing sheet, and when "x" is indicated at the center of "○", it means an arrow directed from the front side to the rear side of the drawing sheet.

In the following description using the drawings, the illustration of a member other than members required for a description for easy understanding, will be appropriately omitted.

EXAMPLE 1

FIG. 1 is an overall explanatory view of an image forming apparatus of Example 1.

In FIG. 1, in a printer U as an example of an image forming apparatus of Example 1 of the present invention, a front cover U1*a* as an example of an opening and closing member is supported on a front surface of a printer main body U1 as an example of an image forming apparatus main body. The front cover U1*a* is supported to be openable about a lower end. When a recording sheet S as an example of a medium is inserted and accommodated, the front cover U1*a* is capable of opening the front side of the printer main body U1.

An exit tray TRh as an example of a discharge unit is formed on an upper surface of the printer U. Further, a rear cover U1*b* as an example of an opening and closing member is rotatably supported at the rear side of the printer main body U1. The rear cover U1*b* is supported to be rotatable between a closed position indicated by a solid line and an opened position indicated by a broken line. The rear cover U1*b* as an example of an opening and closing member is capable of opening the rear side of the printer main body U1 in a case where a paper jam occurs or in a case where an interior inspection and the like are performed.

The printer U of Example 1 has a controller C as an example of a controller. An image processing system IPS, a laser driving circuit DL as an example of a latent image forming circuit, and a power source circuit E are electrically connected to the controller C. Therefore, the controller C is capable of outputting a control signal to the image processing system IPS and the like.

A photoconductor PR as an example of a rotationally driven image carrier is supported at a rear side of the printer U. A charging roller CR, a latent image forming device LH, a developing device G, a transfer roller Tr as an example of a transfer member, and a photoconductor cleaner CL as an example of a cleaning unit for the image carrier are disposed along a rotation direction of the photoconductor PR around the photoconductor PR as an example of a rotating member.

In FIG. 1, a charging roller cleaner CRc as an example of a cleaning unit for a charging unit is disposed to face and be in contact with the charging roller CR.

The latent image forming device LH of Example 1 is configured as a so-called LED head, i.e. a device in which light emitting diodes (LEDs) as an example of a latent image writing element are linearly disposed to be spaced from each other along the right and left direction.

The developing device G has a developing container V in which a developer is accommodated. Within the developing container V, a developing roller Ga as an example of a developer carrier is disposed to face the photoconductor PR. A pair of circulation transport members Gb and Gc and a supply member Gd are disposed within the developing container V in the order of being away from the developing roller Ga. In addition, in the developing container V, a layer thickness regulating member Ge is disposed to face the developing roller Ga.

A developer replenishing port V1 as an example of a replenishing unit is formed in the front-side upper surface of the developing container V. A developer replenishing path V3 as an example of a developer transport path is connected to the developer replenishing port V1. The developer replenishing path V3 is formed in a cylindrical shape extending forward. A replenishing auger V4 as an example of a developer transport member is rotatably supported in the developer replenishing path V3. A cartridge holder KH as an example of an attaching and detaching unit is connected to the front end of the developer replenishing path V3. A toner cartridge TC as an example of an accommodating container for the developer is detachably supported by the cartridge holder KH. An inlet port (not illustrated) is formed in the cartridge holder KH and configured such that the developer is capable of flowing into the inlet port from the toner cartridge TC.

In FIG. 1, a sheet feeding tray TR1 as an example of an accommodating unit that accommodates the medium is disposed at a lower side of the printer U. A pickup roller Rp as an example of a medium ejecting member is disposed at the rear side of the sheet feeding tray TR1. Handling rollers Rs, as an example of a medium handling member, are disposed at a rear side of the pickup roller Rp. Registration rollers Rr as an example of a timing adjusting member are disposed at an upper side of the handling rollers Rs.

A fixing device F is disposed at an upper side of a transfer region Q4 in which the photoconductor PR and the transfer roller Tr face each other. The fixing device F includes a pair of fixing rollers Fh and Fp as an example of a fixing member, and a fixing region Q6 is formed by a press contact region of the pair of fixing rollers Fh and Fp.

Sheet guides SG1 and SG2 as an example of a guide member for the medium are disposed at an upper side of the fixing device F. Discharge rollers R1 as an example of a discharge member are disposed at a front side of the sheet guides SG1 and SG2.

(Description of Image Forming Operation)

Print information is transmitted to the controller C of the printer U from a host computer and the like as an example of an external information transmitting device. When the controller C receives the print information, an image forming operation is started. The controller C outputs the print information to the image processing system IPS. The image processing system IPS converts the print information into image information for forming a latent image, and outputs the image information to a laser driving circuit DL as an example of an image writing circuit at a preset time, that is, at a preset timing. In accordance with the input image information, the laser driving circuit DL outputs a driving signal to the latent image forming device LH.

When the image forming operation is started, the photoconductor PR begins to rotate.

A charging voltage is applied to the charging roller CR from the power source circuit E. In the charging region Q1 where the charging roller CR and the photoconductor PR face each other, the charging roller CR charges the surface of the photoconductor PR.

The charging roller cleaner CRc cleans the surface of the charging roller CR.

In a writing region Q2, the latent image forming device LH forms an electrostatic latent image, which corresponds to the image information, on the surface of the photoconductor PR.

In the developing device G, the pair of circulation transport members Gb and Gc circulate and transport the developer in the developing container V while agitating the developer. The supply member Gd transports the developer agitated by the circulation transport members Gb and Gc to the developing roller Ga. A layer thickness of the developer on a surface of the developing roller Ga is regulated when the developer passes through a region that faces the layer thickness regulating member Ge. A developing voltage is applied to the developing roller Ga from the power source circuit E. In a developing region Q3 where the developing roller Ga and the photoconductor PR face each other, the electrostatic latent image of the photoconductor PR is developed as a visible image by the developer of the developing roller Ga.

According to a consumption amount of the developer in the developing device G, the replenishing auger V4 is driven, and the developing device G is replenished with the developer from the toner cartridge TC.

The pickup roller Rp sends the recording sheet S accommodated in the sheet feeding tray TR1.

In a case in which the pickup roller Rp sends the plural recording sheets S, the handling rollers Rs separate the recording sheets S one by one. The recording sheets S, which are separated by the handling rollers Rs one by one, are sent to the registration rollers Rr. The registration roller Rr transports the recording sheet S to the transfer region Q4 at a predetermined timing.

A transfer voltage is applied to the transfer roller Tr from the power source circuit E. The transfer roller Tr transfers a toner image on the photoconductor PR to the recording sheet S that passes through the transfer region Q4.

In a cleaning region Q5 as an example of a cleaning region set at a downstream side of the transfer region Q4, the photoconductor cleaner CL removes residual toner on the surface of the photoconductor PR.

The recording sheet S, to which the toner image is transferred in the transfer region Q4, is transported to the fixing device F in a state in which the toner image is unfixed.

In the fixing device F, the fixing region Q6 is formed by the press contact region of the fixing rollers Fh and Fp. The toner image is fixed on the recording sheet S transported to the fixing device F by the pair of fixing rollers Fh and Fp in the fixing region Q6.

The recording sheet S, on which the toner image is fixed, is guided by the sheet guides SG1 and SG2.

The discharge rollers R1 discharge the recording sheet S to the exit tray TRh.

(Description of Photoconductor Cleaner CL)

Figure 2:
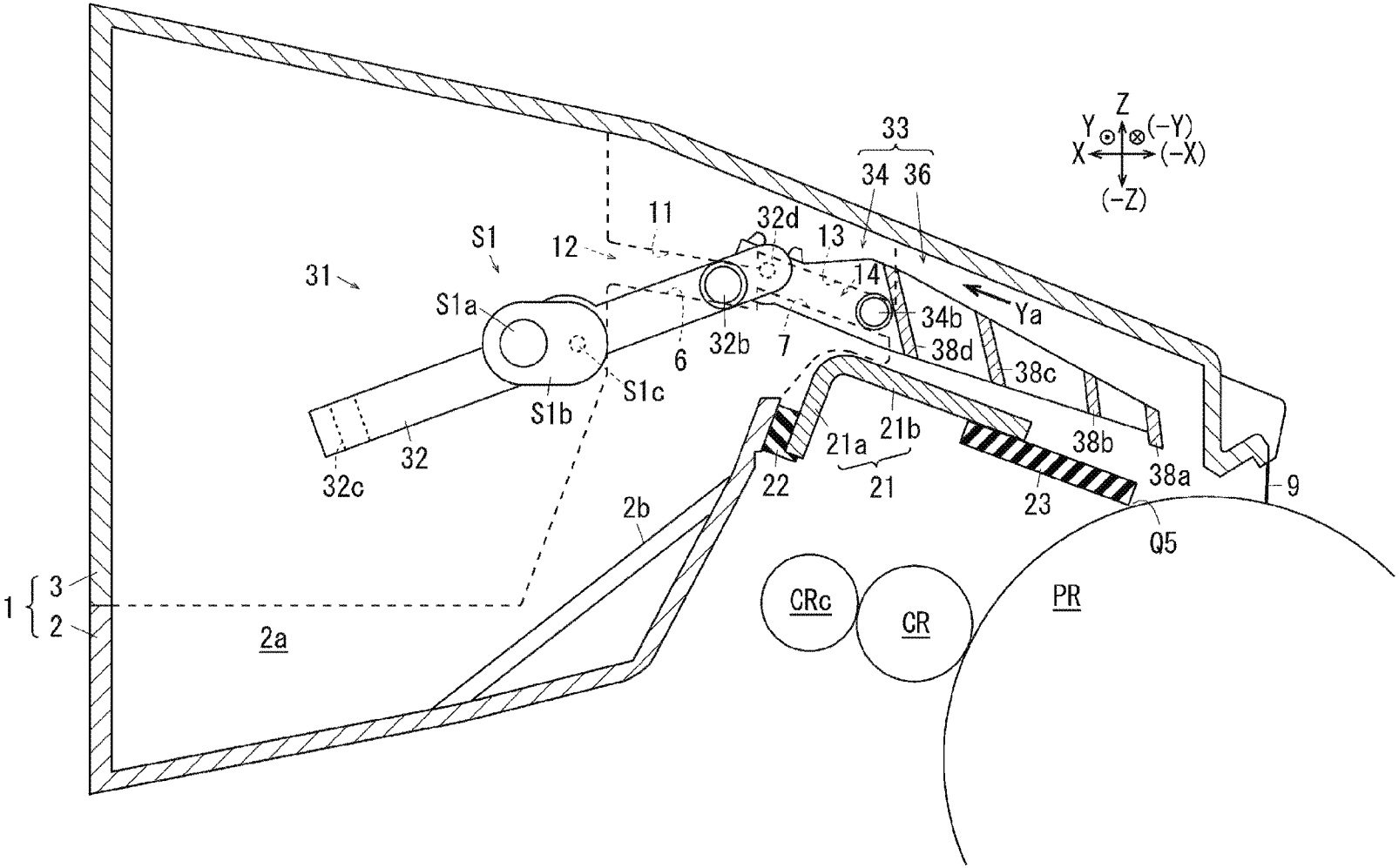
FIG. 2 is an enlarged view of a main part of a photoconductor cleaner of Example 1.

FIG. 2 is an enlarged view of a main part of the photoconductor cleaner of Example 1.

Figure 3:
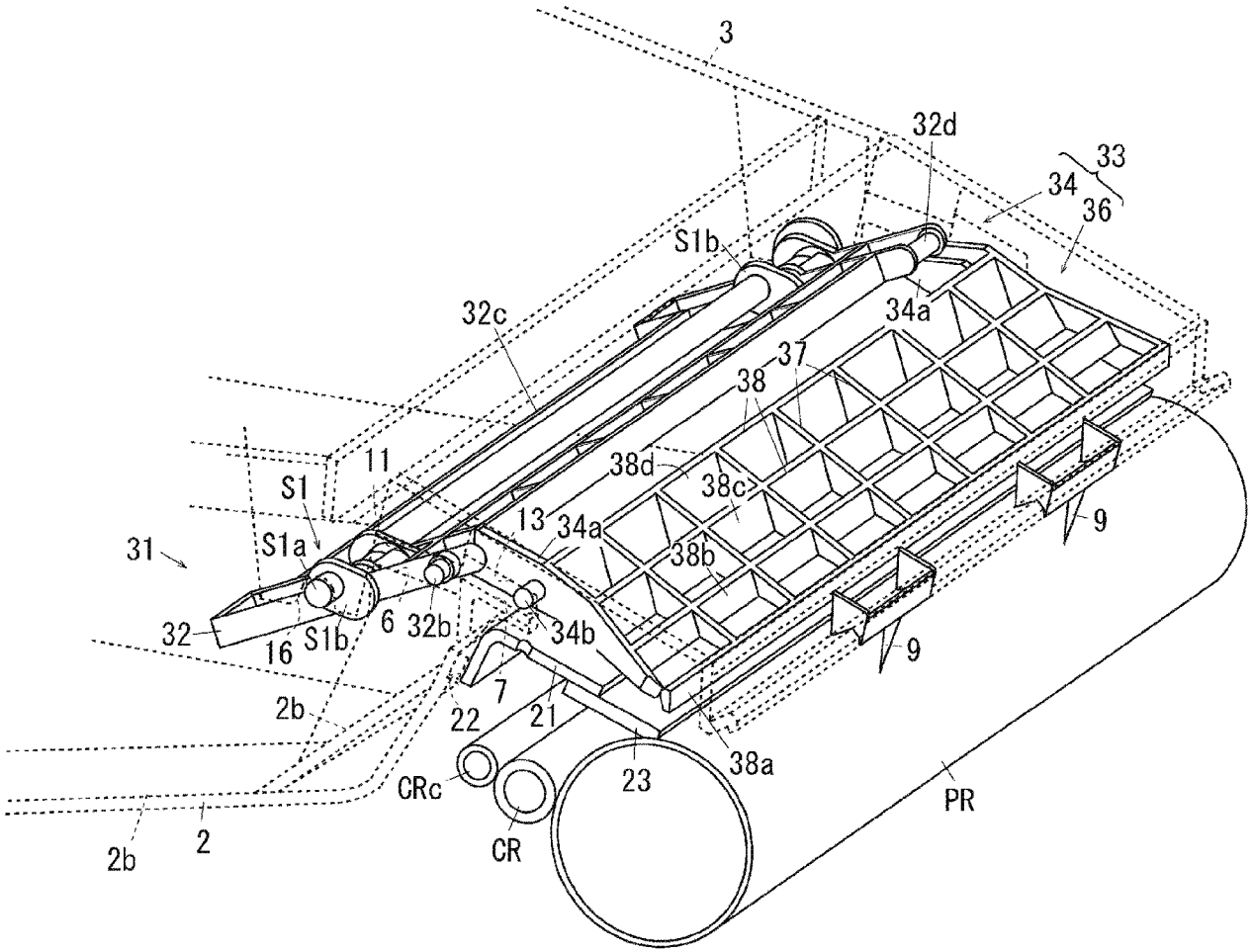
FIG. 3 is a perspective view of a main part of the photoconductor cleaner of Example 1.

FIG. 3 is a perspective view of a main part of the photoconductor cleaner of Example 1.

In FIGS. 1 to 3, the photoconductor cleaner CL of Example 1 includes a cleaner container 1 as an example of a cleaning container. In FIGS. 2 and 3, the cleaner container 1 includes a container main body 2 at the lower side thereof, and a cover 3 as an example of a lid member at the upper side thereof.

The container main body 2 is formed in a box shape and disposed at the front side of the charging roller CR. An accommodating portion 2*a* is formed in the container main body 2. An inclined surface 2*b*, which is inclined upward toward the rear side, is formed at the rear side of the accommodating portion 2*a*. At left and right opposite ends of the container main body 2, first lower guide portions 6 are formed at positions corresponding to an upper side of the inclined surface 2*b*. The upper surfaces of the first lower guide portions 6 are inclined downward toward the rear side. A second lower guide portion 7 is formed at a rear side of each of the first lower guide portions 6. The upper surface of the second lower guide portion 7 is inclined downward toward the rear side. Further, an inclination angle, with respect to a horizontal direction, of the upper surfaces of the second lower guide portions 7 is greater than that of the upper surfaces of the first lower guide portions 6 along the transport direction Ya of the recovered developer.

The cover 3 is formed in a lid shape to cover the upper surface of the container main body 2. The rear end of the cover 3 extends more rearward than the cleaning region Q5. In FIG. 3, separation pawls 9 as an example of a separation member for the medium are supported at the rear end portion of the cover 3. Two separation pawls 9 are disposed to be spaced from each other in a width direction of the recording sheet S.

At the left and right ends of the cover 3, a first upper guide portion 11 is formed at the position corresponding to each first lower guide portion 6. A lower surface of the first upper guide portion 11 is formed to be parallel with the upper surface of the first lower guide portion 6. A first guide groove 12 as an example of a first regulating portion is configured with a space between the first lower guide portion 6 and the first upper guide portion 11. The first guide groove 12 of Example 1 is formed approximately along the transport direction Ya of the developer.

At each the left and right ends of the cover 3, a second upper guide portion 13 are formed at a position facing the second lower guide portion 7. The lower surface of the second upper guide portion 13 is formed to be parallel with the upper surface of the second lower guide portion 7. A second guide groove 14 as an example of a second regulating portion is configured with a space between the second lower guide portion 7 and the second upper guide portion 13. The second guide groove 14 of Example 1 is formed along the transport direction of the developer.

At each of the left and right ends of the cover 3, a bearing unit 16 is formed at a front lower side of the first lower guide portion 6.

In FIGS. 2 and 3, a blade holder 21 as an example of a support body for a cleaning member is supported on an external surface at an upper side of the rear end of the container main body 2. The blade holder 21 of Example 1 is supported on the container main body 2 via a seal 22 as an example of a sealing member.

In addition, the blade holder 21 of Example 1 is formed by bending a metal plate in an L shape. The blade holder 21 has a supported portion 21*a* supported on the seal 22, and a holder main body 21*b* extending from the upper end of the supported portion 21*a* toward the cleaning region Q5.

A cleaning blade 23 as an example of a cleaning member is supported on a lower surface of the rear end of the holder main body 21*b*. In the cleaning region Q5, a tip end of the cleaning blade 23 is in contact with the photoconductor PR. The cleaning blade 23 of Example 1 is configured with a rubber blade as an example of an elastic material.

Therefore, in Example 1, a space surrounded by the upper surfaces of the holder main body 21*b* and the cleaning blade 23 and the cover 3 becomes a transport path through which the developer recovered in the cleaning region Q5 is transported. In addition, the transport direction Ya of the developer is a direction that is coincident with the inclination of the upper surface of the cleaning blade 23.

In addition, in the present disclosure, the description "along the transport direction of the developer" is not limited only to being exactly parallel with the transport direction of the developer, but is used to mean that its main component is the transport direction of the developer, that is, to mean including directions in the range of ±45 degrees with respect to the transport direction of the developer without.

Figure 4:
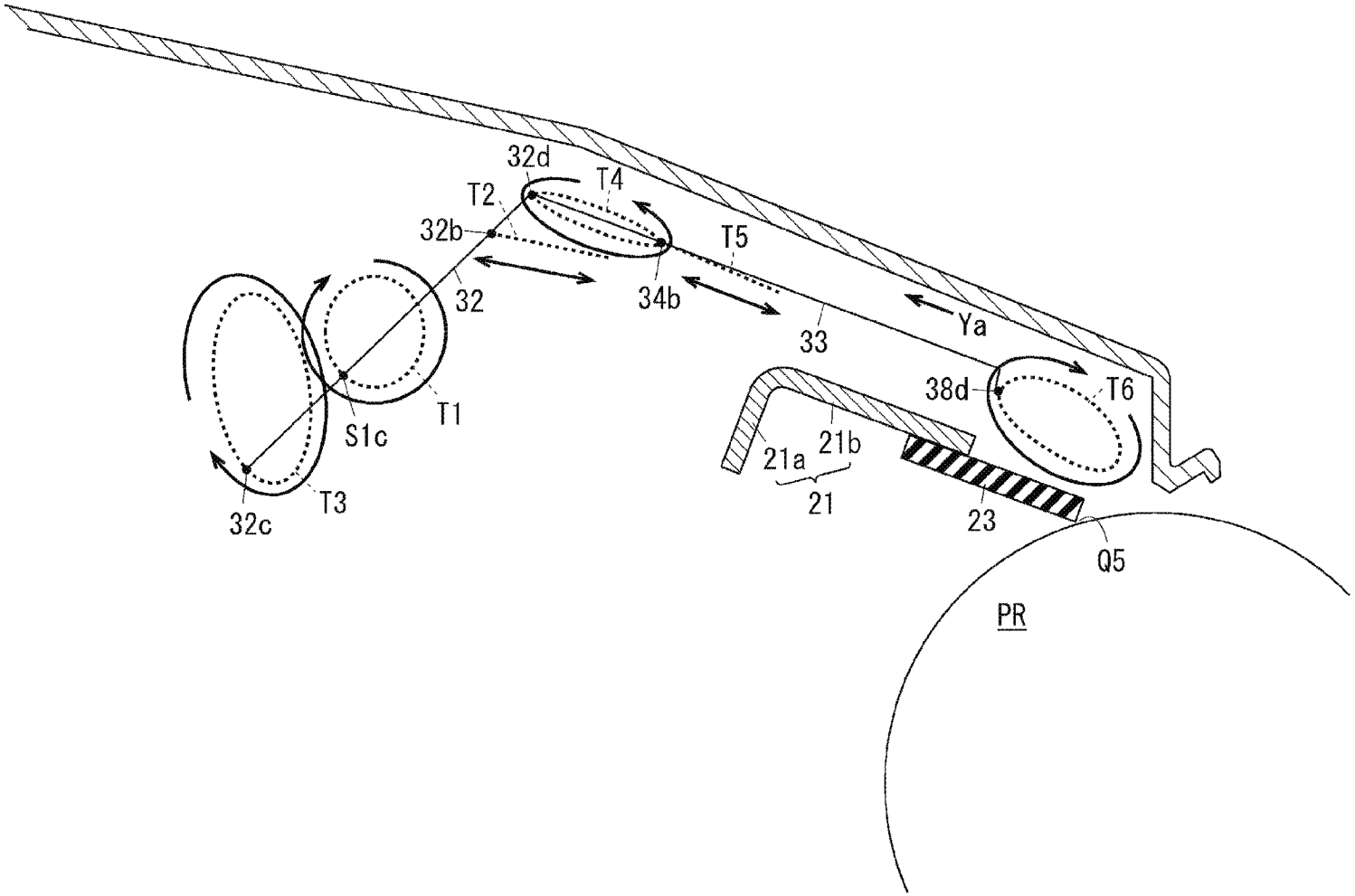
FIG. 4 is an explanatory view of a rotational trajectory of each part in a transport member of Example 1.

FIG. 4 is an explanatory view of a rotational trajectory of each part in the transport member of Example 1.

In FIGS. 2 and 3, a transport member 31 is disposed at an upper side of the cleaning blade 23. The transport member 31 has an agitation unit 32 as an example of a first transport body at the front side thereof, and a transport unit 33 as an example of a second transport body at the rear side thereof.

The agitation unit 32 has a configuration of a grid pattern combined with a plate-shaped member that extends in the right and left direction and the front and rear direction. A crank shaft S1 as an example of a shaft member is disposed at a central portion in the front and rear direction of the agitation unit 32. The crank shaft S1 has a rotation center S1*a*, and a connecting member S1*b* as an example of an eccentric portion that is eccentric from the rotation center S1*a*. The connecting member S1*b* is configured with a member that extends in a radial direction of the crank shaft S1. The agitation unit 32 is rotatably supported at the radial outer end the connecting member S1*b* in the radial direction. Therefore, in Example 1, a connecting portion S1*c* between the agitation unit 32 and the connecting member S1*b* rotates along a crank trajectory T1 in FIG. 4 as the crank shaft S1 rotates.

In FIG. 3, the opposite left and right end portions of the crank shaft S1 about the rotation center S1*a* are rotatably supported by the bearing units 16. The crank shaft S1 is formed in a rod shape extending in the right and left direction. The left end of the crank shaft S1 penetrates the cleaner container 1 and extends to the outside, and a driving power is transmitted from a non-illustrated motor as an example of a driving source.

At the rear end portion of the agitation unit 32, first guide projections 32*b* as an example of a first guided portion are formed as an example of a first regulated portion. The first guide projections 32*b* are formed to protrude outward from the left and right ends of the agitation unit 32. The first guide projections 32*b* are supported in a state of being fitted into the first guide grooves 12, respectively. Therefore, the first guide projections 32*b* are supported to be movable along the first guide grooves 12, respectively. Accordingly, the first guide projections 32*b* move along a first projection trajectory T2 in FIG. 4.

Therefore, the agitation unit 32 is supported by the crank shaft S1 and the first guide projections 32*b*, and supported in the cleaner container 1 in a posture inclined downward toward the left side.

A pushing portion 32*c* is formed at the front end of the agitation unit 32. Further, the pushing portion 32*c* of Example 1 rotates along a pushing trajectory T3 in FIG. 4 as the crank shaft S1 rotates.

At the rear end of the agitation unit 32, a transport connection portion 32*d* as an example of a first support portion is formed at a position more forward than the first guide projection 32*b*. Further, in Example 1, the agitation unit 32 is supported by the connecting member S1*b* of the crank shaft S1 and the first guide projection 32*b* such that as the crank shaft S1 rotates, the transport connection portion 32*d* rotates along an elliptical trajectory elongated in the transport direction of the developer as indicated by a connection portion trajectory T4 in FIG. 4.

In FIGS. 2 and 3, the front end portion of the transport unit 33 is rotatably supported by the transport connection portion 32*d* of the agitation unit 32. The transport unit 33 has a downstream portion 34 at the front side thereof, and an upstream portion 36 at the rear side thereof.

The downstream portion 34 has a pair of left and right frame portions 34*a* at the left and right ends thereof. Further, no member is disposed inside the frame portion 34*a* of the downstream portion 34 of Example 1. A position regulating projection 34*b* as an example of a second guide portion is formed at a rear end of the downstream portion 34 an example of a second regulating portion. The position regulating projection 34*b* is supported to be movable along the second guide groove 14. Accordingly, the position regulating projection 34*b* moves along a second projection trajectory T5 in FIG. 4. Further, as illustrated in FIG. 4, in Example 1, the movable range of the position regulating projection 34*b* along the transport direction of the developer is set to a downstream side (front side) across the position of the supported portion 21*a* of the blade holder 21.

Therefore, the transport unit 33 of Example 1 is supported in the cleaner container 1 by the transport connection portion 32*d*, which is a portion connected to the agitation unit 32, and the position regulating projection 34*b*. Accordingly, as the crank shaft S1 rotates, a tip end of the upstream portion 36 of the transport unit 33 rotates along an elliptical trajectory elongated along the transport direction of the developer as indicated by a transport trajectory T6 in FIG. 4. Further, in Example 1, in a state viewed in a direction represented in FIG. 4, the rotation directions of the crank trajectory T1, the pushing trajectory T3, and the transport trajectory T6 are set to be rotated in a clockwise direction, and the rotation direction of the connection portion trajectory T4 is set to be rotated in a counterclockwise direction.

When the connection portion 32*d* is positioned on the holder main body 21*b* of the blade holder 21, the developer on the holder main body 21*b* is transported in a direction opposite to the transport direction Ya. Accordingly, in Example 1, the movable range of the position regulating projection 34*b* is set such that a trajectory of the connection portion 32*d* is the trajectory T4 downstream of a bent portion of the blade holder 21 (a position where a lower surface of a transport path of the developer is bent), that is, such that the connection portion 32*d* is not positioned on the holder main body 21*b*.

In FIGS. 2 and 3, the upstream portion 36 is formed in a grid pattern having vertical frame portions 37 as an example of a support portion, and horizontal frame portions 38 as an example of a main body of the transport unit. The vertical frame portions 37 are formed in a plate shape extending in the front and rear direction, and the horizontal frame portions 38 are formed in a plate shape extending in the right and left direction. Further, in Example 1, a lower surface of the upstream portion 36 is disposed to be spaced from the upper surfaces of the holder main body 21*b* and the cleaning blade 23 so as not to be in contact with the upper surfaces of the holder main body 21*b* and the cleaning blade 23 when the transport member 31 is moved.

The vertical frame portion 37 is configured such that a width in the up and down direction is increased from the rear side, which is the upstream side, toward the front side which is the downstream side with respect to the transport direction Ya of the developer along the holder main body 21*b*. In addition, plural vertical frame portions 37 are disposed to be spaced from each other in the width direction of the recording sheet S.

Figure 5:
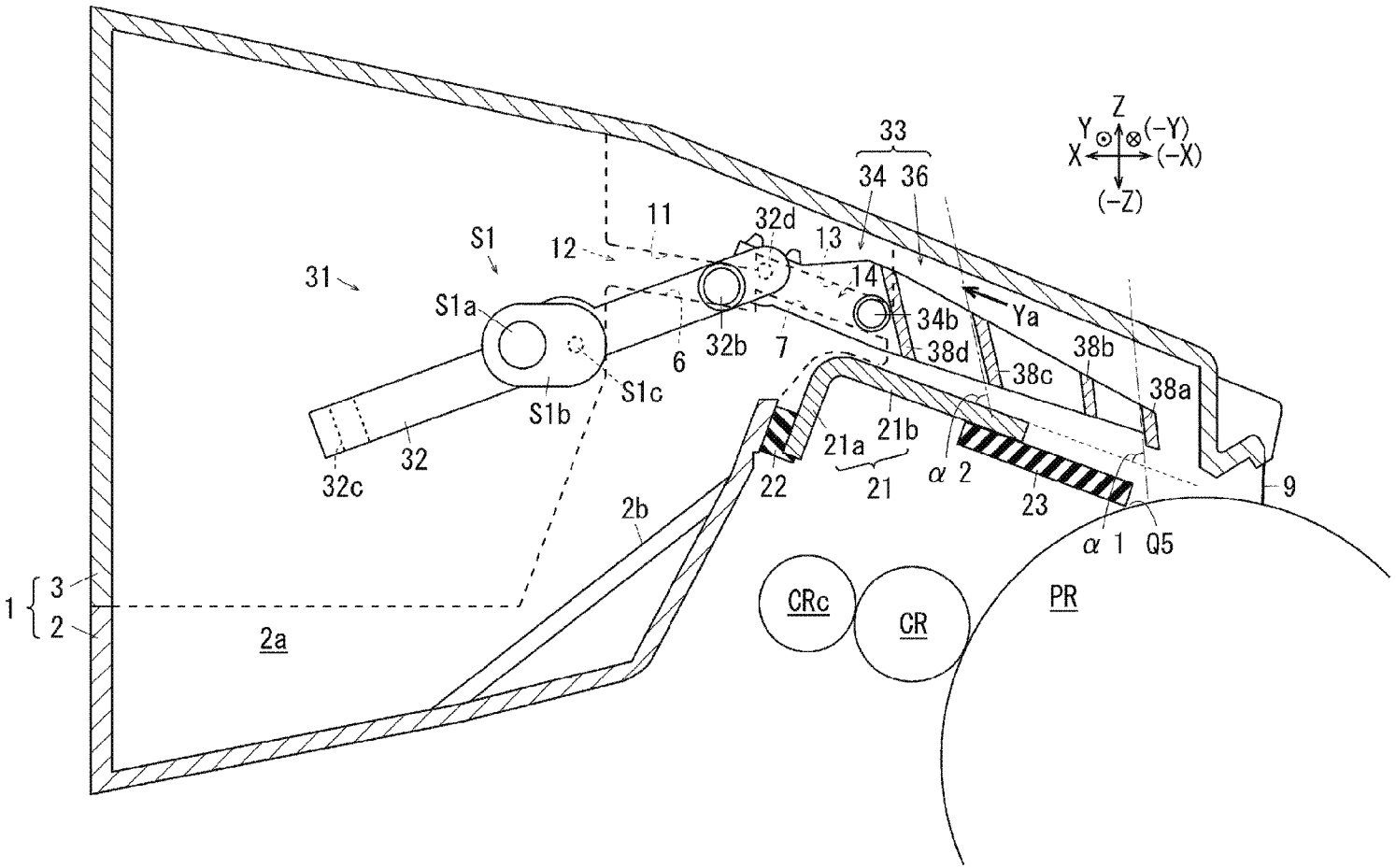
FIG. 5 is an explanatory view of an inclination angle of a horizontal frame portion of Example 1.

FIG. 5 is an explanatory view of an inclination angle of the horizontal frame portions of Example 1.

In FIGS. 2, 3, and 5, the horizontal frame portions 38 are formed to be connected to the respective vertical frame portions 37 in the right and left direction. Four horizontal frame portions 38 are disposed to be spaced from each other in the transport direction Ya of the developer. That is, in FIG. 4, Example 1 includes a first horizontal frame portion 38*a*, a second horizontal frame portion 38*b*, a third horizontal frame portion 38*c*, and a fourth horizontal frame portion 38*d* in this order from the upstream side in the transport direction Ya of the developer.

In FIG. 5, in Example 1, the front surfaces of the respective horizontal frame portions 38*a* to 38*d* are inclined in a direction approaching the holder main body 21*b* or the cleaning blade 23 toward the upstream side in the transport direction Ya of the developer. The inclination angle $\alpha 1$, in the transport direction Ya of the developer, of the front surfaces of the first horizontal frame portion 38*a* and the second horizontal frame portion 38*b*, which are disposed to corresponding to a position of the cleaning blade 23, is set to be larger than the inclination angle $\alpha 2$ of the front surfaces of the third horizontal frame portion 38*c* and the fourth horizontal frame portion 38*d*, which are disposed to correspond to the holder main body 21*b*. That is, the inclination angles are set to be $\alpha 1 > \alpha 2$.

(Function of Photoconductor Cleaner)

Figure 6C:
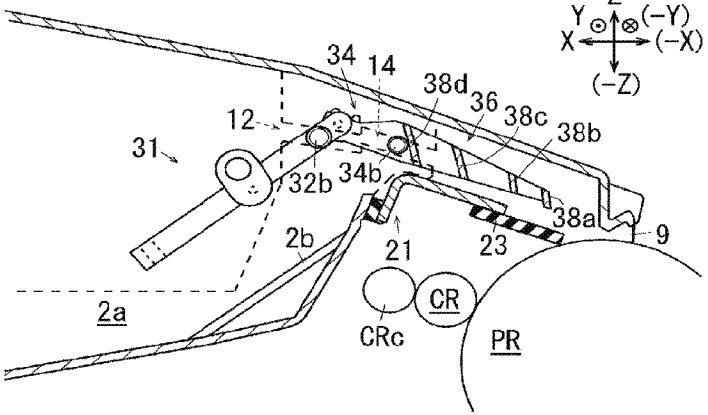
Figure 6D:
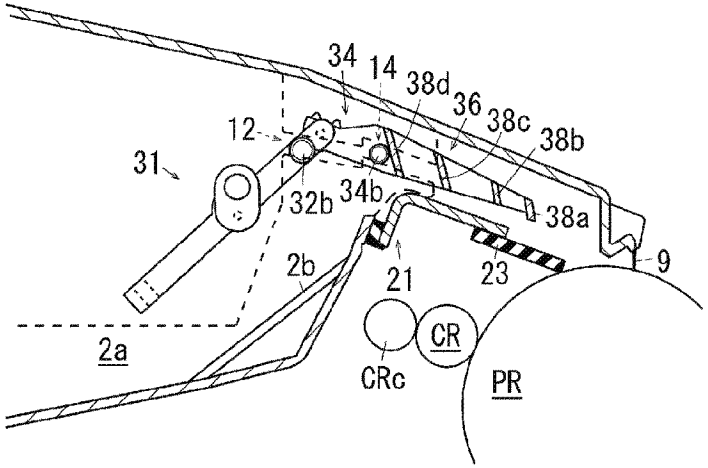
Figure 6A:
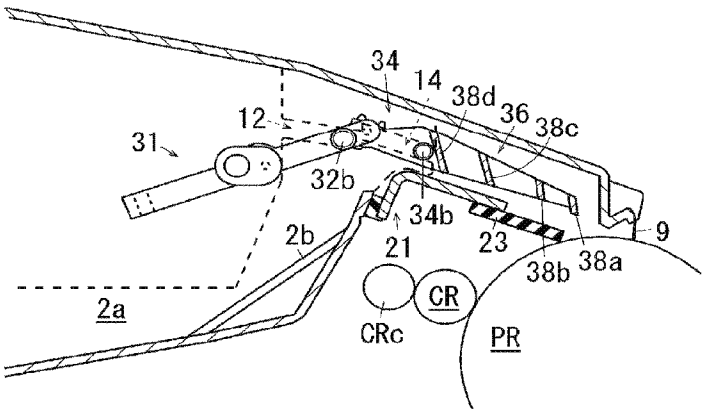
Figure 6B:
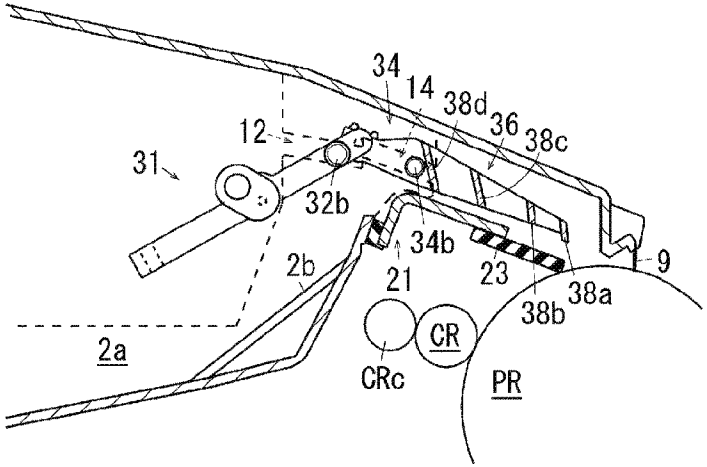

FIGS. 6A to 6D are explanatory views of an operation of the transport member of Example 1, in which FIG. 6A is an explanatory view illustrating the same state as FIG. 2, FIG. 6B is an explanatory view illustrating a state in which the transport member is rotated by about 30° about a rotation axis from the state of FIG. 6A, FIG. 6C is an explanatory view illustrating a state in which the transport member is rotated by about 30° about the rotation axis from the state of FIG. 6B, and FIG. 6D is an explanatory view illustrating a state in which the transport member is rotated by about 30° about the rotation axis from the state of FIG. 6C.

Figure 7A:
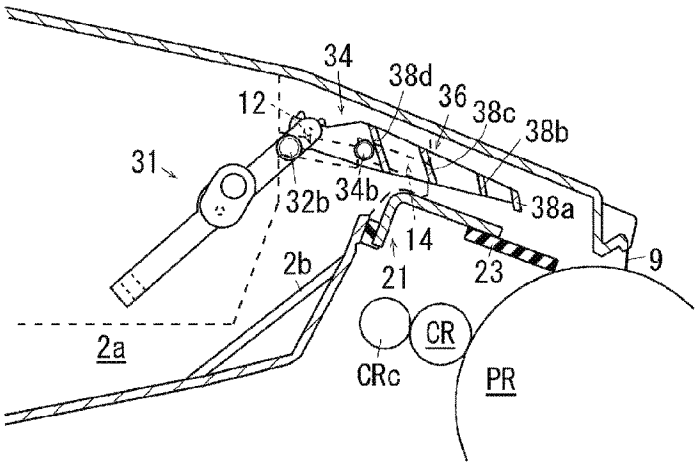
Figure 7B:
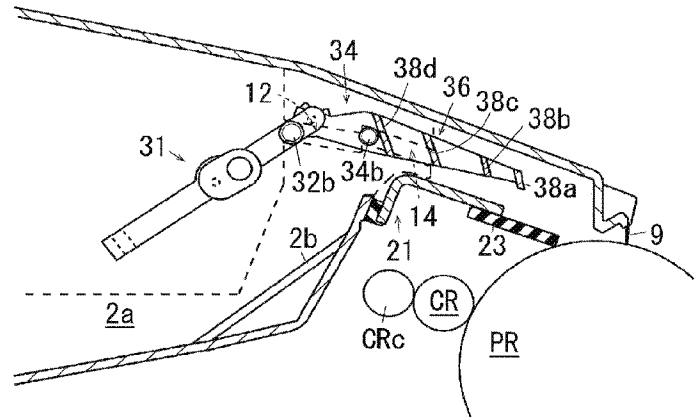
Figure 7C:
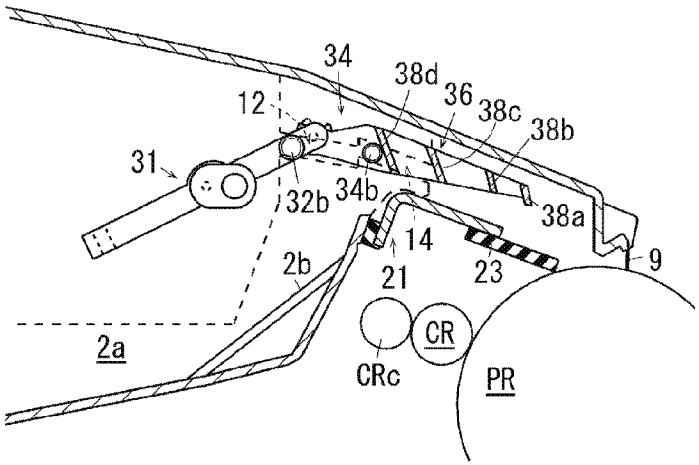
Figure 7D:
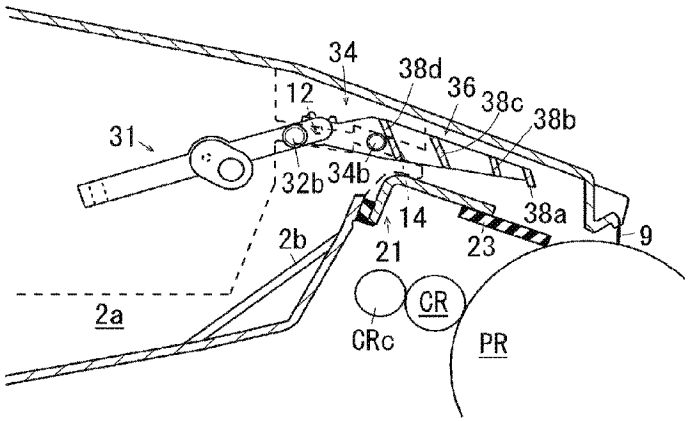

FIGS. 7A to 7D are explanatory views of an operation of the transport member of Example 1, in which FIG. 7A is an explanatory view illustrating a state in which the transport member is rotated by about 30° about the rotation axis from the state of FIG. 6D, FIG. 7B is an explanatory view illustrating a state in which the transport member is rotated by about 30° about the rotation axis from the state of FIG. 7A, FIG. 7C is an explanatory view illustrating a state in which the transport member is rotated by about 30° about the rotation axis from the state of FIG. 7B, and FIG. 7D is an explanatory view illustrating a state in which the transport member is rotated by about 30° about the rotation axis from the state of FIG. 7C.

Figure 8A:
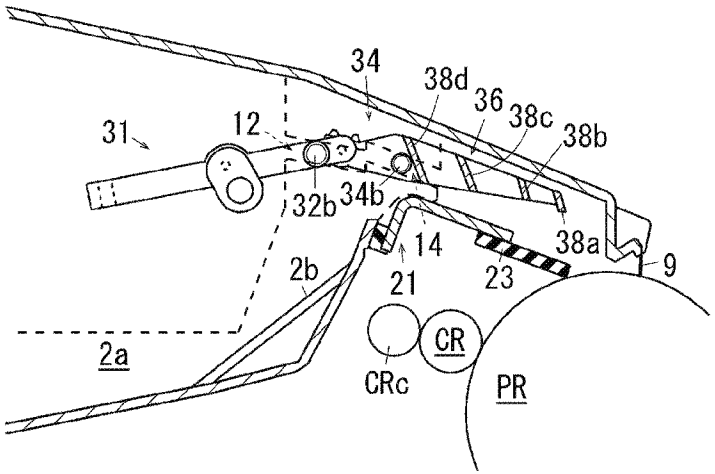
Figure 8B:
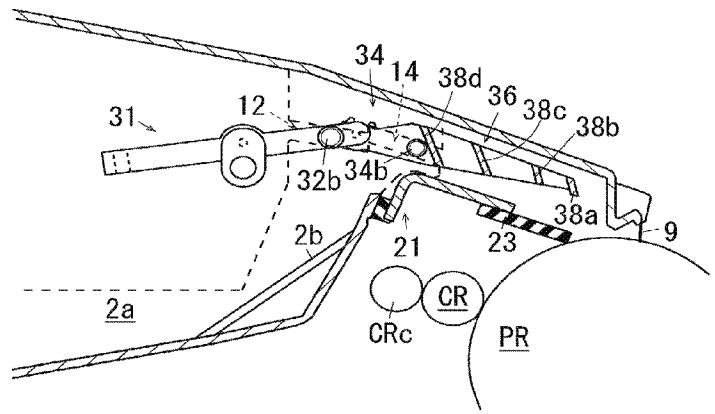
Figure 8C:
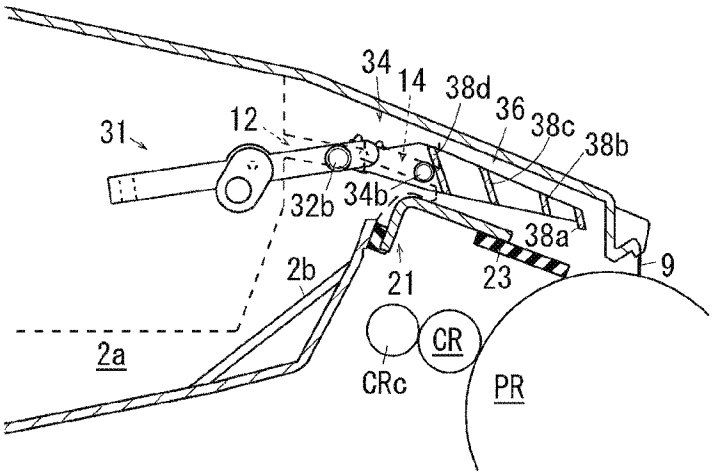
Figure 8D:
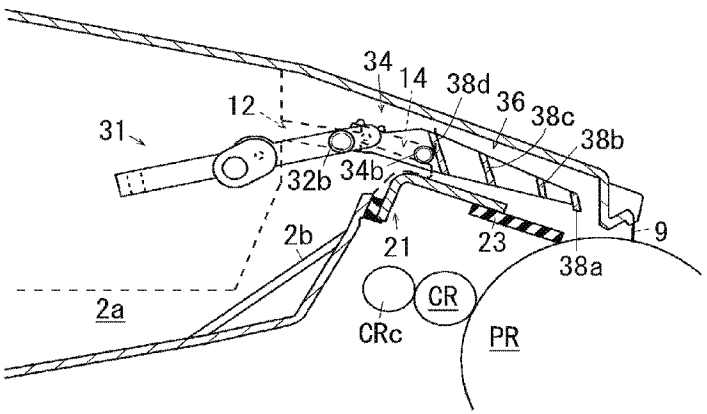

FIGS. 8A to 8D are explanatory views of an operation of the transport member of Example 1, in which FIG. 8A is an explanatory view illustrating a state in which the transport member is rotated by about 30° about the rotation axis from the state of FIG. 7D, FIG. 8B is an explanatory view illustrating a state in which the transport member is rotated by about 30° about the rotation axis from the state of FIG. 8A, FIG. 8C is an explanatory view illustrating a state in which the transport member is rotated by about 30° about the rotation axis from the state of FIG. 8B, and FIG. 8D is an explanatory view illustrating a state in which the transport member is rotated by about 30° about the rotation axis from the state of FIG. 8C.

(Function of Cleaner)

In the printer U of Example 1 configured as described above, when the image forming operation is started, the motor is driven, and the crank shaft S1 is rotated. The agitation unit 32 is connected with the crank shaft S1 through the connecting member S1*b*, and supported by the first guide groove 12 through the first guide projection 32*b*. Therefore, when the crank shaft S1 rotates, the transport connection portion 32*d* reciprocally moves along the connection portion trajectory T4 elongated in the transport direction as illustrated in FIGS. 6A to 8D.

As a result, the transport unit 33 also moves as follows: the first horizontal frame portion 38*a*, which is the tip end, moves to the downstream side along the transport direction Ya of the developer as illustrated in FIGS. 6A to 6D, then moves to the upstream side in the opposite direction to the transport direction Ya of the developer while moving upward as illustrated in FIGS. 7A to 7D, and then moves rightward and downward as illustrated in FIGS. 8A to 8D. Therefore, the tip end of the transport unit 33 also reciprocally moves along the transport trajectory T6 having an approximately elliptical shape elongated along the transport direction.

Here, in a configuration in which a hook portion 43*d* performs a circular movement when the hook portion 43*d* moves to the cleaning blade 31 side as in the technique disclosed in JP-A-2005-010751, the hook portion 43*d* moves in a state in which the hook portion 43*d* is greatly spaced from a cleaning blade 31. Accordingly, a space is required at the upper side so as to allow the hook portion 43*d* to move. Accordingly, in the configuration disclosed in JP-A-2005-010751, there is a problem in that the recovery container 20 is enlarged. When the radius of rotation is decreased in order to downsize the recovery container 20, the movement amount of the hook portion 43*d* is also decreased, and as a result, it is impossible to secure a necessary transport performance. Accordingly, there occurs a problem in that the toner is blocked. In addition, when the radius of rotation is to be adjusted, there is also a problem in that a degree of freedom in terms of the position of a rotation axis is also restricted. In addition, when the radius of rotation is decreased, there is a problem in that a range in which a slot 43*f* for pushing the developer functions is also restricted. In a case in which an L-shaped or T-shaped member is added in order to enhance the function of the slot 43*f*, there is a problem in that when the total amount of recovered developer is increased, the torque applied to the driving source is excessively increased.

As in JP-A-2005-010751, in the configuration disclosed in JP-A-2011-149981, a tip end portion of a waste toner transport member is configured to greatly shake in the up and down direction in accordance with eccentricity of the rotation axis. Accordingly, is the configuration of Patent Document 2 has the same problem. This is because the transport members disclosed in JP-A-2005-010751 and JP-A-2011-149981 are configured such that a single transport member is directly driven by the crank shaft.

Whereas, in Example 1, the transport member 31 is configured such that the agitation unit 32 and the transport unit 33 are connected by the transport connection portion 32*d*, and the tip end of the transport unit 33 moves along the transport trajectory T6 having an approximately elliptical shape elongated in the transport direction. Accordingly, compared with the configurations of JP-A-2005-010751 and JP-A-2011-149981, it is possible to reduce the space at the upper side of the cleaning blade 23 in the cleaner container 1 while securing the transport performance of the transport member 31. Accordingly, compared with the configurations of JP-A-2005-010751 and JP-A-2011-149981, it is possible to minimize the photoconductor cleaner CL while ensuring the transport performance.

In addition, in the photoconductor cleaner CL of Example 1, in a state in which the transport unit 33 is in the states illustrated in FIGS. 6A to 6D, the developer, which is pushed by the front surface of the first horizontal frame portion 38*a* and recovered from the photoconductor PR by the cleaning blade 23, is transported toward the accommodating portion 2*a*. Further, in the states illustrated in FIGS. 7A to 7D, the first horizontal frame portion 38*a* moves to the upstream side in the transport direction Ya of the developer while being spaced away from the cleaning blade 23 and the holder main body 21*b*. Therefore, as compared with the case in which the first horizontal frame portion 38*a* is not spaced away from the cleaning blade 23 and the like, the developer, which is transported to the downstream side in FIGS. 6A to 6D, is less transported in the reverse direction. Further, as illustrated in FIGS. 8A to 8D, the first horizontal frame portion 38*a* moves to a position in the vicinity of the cleaning region Q5, and returns to the state of FIG. 6A.

Therefore, in the photoconductor cleaner CL in Example 1, the developer recovered by the cleaning blade 23 is transported to the accommodating portion 2*a* by the transport member 31. Further, the developer transported to the accommodating portion 2*a* is pushed into the interior of the accommodating portion 2*a* by the pushing portion 32*c* that rotates along the pushing trajectory T3. In addition, when the developer transported to the accommodating portion 2*a* is accumulated, the developer is leveled by being agitated by the agitation unit 32 that reciprocally moves. In particular, in Example 1, the pushing portion 32*c* reciprocally moves along a trajectory having an elliptical shape that is relatively long in the vertical direction as indicated by the pushing trajectory T3. Accordingly, it is easy to agitate the developer while pushing the developer downward to be pressed. Accordingly, the recovered developer can be easily pressed, and the recoverable amount of the developer can be increased compared with a case in which the developer is not pressed.

Here, in the photoconductor cleaner CL of Example 1, the horizontal frame portions 38*a* to 38*d* have surfaces (upper surfaces and lower surfaces) inclined to the upper surface side of the holder main body 21*b* and the like toward the upstream side in the transport direction Ya of the developer. Therefore, as illustrated in FIGS. 6A to 6D, when the horizontal frame portions 38*a* to 38*d* move from the upstream side to the downstream side in the transport direction Ya of the developer, the developer on the upper surface of the holder main body 21*b* or the cleaning blade 23 receives a force in a direction in which the developer is pressed against the upper surface of the holder main body 21*b* or the like. Here, as the related art disclosed in JP-A-2009-145661, in a configuration in which a reciprocal movement is performed only in the transport direction of the developer in a state in which a gap exists between the bottom surface of a transport path and a transport member, there is a problem in that the developer in the gap is not transported. When the developer stagnates without being transported, the developer tightly adheres over time, thereby becoming transport resistance of the developer. When the transport resistance is increased, there is a concern that the reciprocal movement of the transport member is hindered so that a transport failure occurs.

Whereas, in Example 1, a force is applied to push the developer against the upper surfaces of the holder main body 21*b* and the like which are the bottom surfaces of the transport path. Therefore, when the transport unit 33 moves in the transport direction Ya of the developer in a state in which the force to push the developer is applied, not only the developer, which is in direct contact with the horizontal frame portions 38*a* to 38*d*, but also the developer, which is pushed by the developer, which is in direct contact with the horizontal frame portions 38*a* to 38*d*, to be present between the transport unit 33 and the upper surfaces of the holder main body 21*b* and the like, is easily transported in the transport direction Ya of the developer. Therefore, compared with the technique disclosed in JP-A-2005-010751, the transport efficiency (recovery efficiency) of the developer is improved. Accordingly, the stagnation of the developer is reduced, and the transport failure of the developer is also reduced.

In addition, in Example 1, when the developer is pushed against the holder main body 21*b* and the like, the developer is pressed so that the volume of the developer is decreased. Therefore, in the transport member 31 in Example 1, the developer tends to become a solidified state. When the developer still remains in the form of powder in the configuration disclosed in JP-A-2005-010751, the developer moves to flow out from upper, lower, left, and right sides, and as a result the transport efficiency of the developer deteriorates. However, when the developer is in the solidified state as in Example 1, the developer is pushed by the horizontal frame portion 38 to be easily transported. Accordingly, the transport efficiency of the developer is improved.

In addition, in a configuration in which a transport member is made by crossing wires in a grid pattern as in the configuration disclosed in JP-A-2011-149981, it is very difficult to apply a force for pushing the developer toward the bottom surface of the transport path.

In Example 1, the inclination angle $\alpha$1 of the horizontal frame portions 38*a* and 38*b* corresponding to the cleaning blade 23 is greater than the inclination angle $\alpha$2 of the horizontal frame portions 38*c* and 38*d* corresponding to the holder main body 21*b*. When the inclination angle $\alpha$1 is small, the force for pushing the developer against the cleaning blade 23 or the holder main body 21*b* becomes strong. When the cleaning blade 23 made of an elastic material receives an external force, there is a concern that the value of pressure and the distribution of pressure in the width direction in the cleaning region Q5 are adversely affected. That is, there is a concern that the cleaning efficiency deteriorates so that a cleaning failure occurs. Whereas, in Example 1, an adverse influence on the cleaning blade 23 is reduced compared with a case in which the inclination angle $\alpha$1 of the horizontal frame portions 38*a* and 38*b* corresponding to the cleaning blade 23 is equal to the inclination angle $\alpha$2 of the horizontal frame portions 38*c* and 38*d* corresponding to the holder main body 21*b*. Accordingly, the occurrence of the cleaning failure is reduced.

In Example 1, the transport member 31 is provided with the horizontal frame portions 38 at the upstream portion 36 thereof, but is not provided the horizontal frame portions 38 at the downstream portion 34 thereof. Therefore, the downstream portion 34 is poor compared with the upstream portion 36 in terms of the ability of transporting the developer to the downstream side in the transport direction Ya.

The transport member 31 of Example 1, a moves in a reverse flow direction in relation to the transport direction Ya when the trajectory of a reciprocal movement transits from the state illustrated in FIG. 7A to the state illustrated in FIG. 8A via the states illustrated in FIGS. 7B, 7C, and 7D. Here, in a case in which the transport force at the upstream portion and the transport force at the downstream portion are the same, when the amount of recovered developer is increased, a part of the developer may flow reversely when the transport member moves in the reverse flow direction (−Ya). When a part of the developer flows reversely, a situation occurs in which the developer is not transported to the downstream side, and a part of the developer stagnates. Therefore, the situation in which the developer stagnates grows up toward the downstream side in the developer transport direction Ya. Accordingly, there is a concern that the developer aggregates at the downstream side in the transport direction Ya of the developer by a force for transporting the developer from the upstream side and a force for pushing the developer in the reverse flow direction. When the developer aggregates at a position in the middle of the transport member, there is a concern that the developer is blocked so that a transport failure of the developer occurs.

Whereas, in Example 1, the transport force of the downstream portion 34 is low compared to the upstream portion 36. Accordingly, the force received by the developer in the reverse flow direction is lower than the force received by the developer in the transport direction Ya. Therefore, in Example 1, the aggregation of the developer is reduced compared with a case in which the transport force at the upstream portion and the transport force at the downstream portion are the same. Accordingly, a transport failure of the developer is reduced.

In particular, when the transport member 31 of Example 1 moves in the reverse flow direction (−Ya direction), the transport member 31 moves in the reverse flow direction (−Ya direction) while moving upward, and as a result, the reverse flow is further reduced compared with the configuration in which the transport member 31 does not move upward.

In Example 1, the transport force of the developer at the downstream portion 34 is zero. Accordingly, the force in the reverse flow direction, which is received by the developer, becomes zero. Therefore, compared with a case in which the downstream portion 34 has the transport force, the aggregation of the developer is further reduced. Further, the developer transported to the range of the downstream portion 34 is pushed by the developer transported from the upstream side at the upstream portion 36 and is transported to the downstream side.

In Example 1, as illustrated in FIGS. 6A to 8D, a downstream end of the downstream portion 34 is disposed downstream of the upstream end of the inclined surface 2*b* of the container main body 2. In particular, in Example 1, the downstream portion 34 is disposed across the upstream end of the inclined surface 2*b* of the container main body 2. Accordingly, the downstream portion 34 in the transport direction Ya is disposed across the upstream end of the inclined surface 2*b*.

Therefore, when the developer transported to the range of the downstream portion 34 approaches a position of the upstream end of the inclined surface 2*b*, the developer falls by gravity toward the inclined surface 2*b*. Accordingly, in the range of the downstream portion 34, the blockage of the developer is reduced.

In Example 1, in the transport member 31, the agitation unit 32 and the transport unit 33 are rotatably connected. In the configuration in which the transport member has a flat plate shape as in the configurations disclosed in JP-A-2005-010751 and JP-A-2011-149981, a length along the transport direction is also increased, and thus it is difficult to reduce the overall size of the photoconductor cleaner CL. Whereas, in Example 1, the agitation unit 32 and the transport unit 33 are rotatably connected so that the transport member 31 is supported in a bent state. Therefore, compared with the configurations disclosed in JP-A-2005-010751 and JP-A-2011-149981, it is possible to reduce the overall length of the transport member 31, and to miniaturize the photoconductor cleaner CL.

(Examples of Variations)

While the example of the present invention has been described in detail, the present invention is not limited to the example, and various variations may be made within the scope of gist of the present invention disclosed in the claims. Variations H01 to H011 of the present invention are exemplified as follows.

(H01) In the above described example, a printer U is exemplified as an example of an image forming apparatus. Without being limited thereto, however, the image forming apparatus may be, for example, a copier, a FAX, or a multifunction machine having plural or all functions thereof.

(H02) In the above described example, the printer U is exemplified as having a configuration in which a monochromatic developer is used. Without being limited thereto, however, the present invention may also be applied to, for example, an apparatus for forming a multiple color image having two or more colors.

(H03) In the above described example, the inclination angles $\alpha 1$ and $\alpha 2$ of the horizontal frame portions 38 may be set to be $\alpha 1 > \alpha 2$ as exemplified in the example, but the present invention is not limited thereto. For example, the inclination angles $\alpha 1$ and $\alpha 2$ may be set to be $\alpha 1 = \alpha 2$. In addition, regarding the four horizontal frame portions 38*a* to 38*d*, for example, a variation may be made to the configuration in such a manner in which the inclination angle is increased toward the downstream side. Further, the number of horizontal frame portions 38*a* to 38*d* may be three or less, or five or more without being limited to four. Further, the vertical frame portions 37 may be provided for strength, but a configuration may be made in which no vertical frame portion is provided.

(H04) In the above described example, a configuration in which the downstream portion 34 of the transport member 31 does not have transport ability is exemplified, but the present invention is not limited thereto. The configuration may be made such the downstream portion 34 has lower transport ability than that of the upstream portion 36. For example, the horizontal frame portions may be provided in such a manner that the interval of the horizontal frame portions in the downstream portion 34 is wider than that in the upstream portion 36. Alternatively, the horizontal frame portions may be provided in such a manner that the height of the horizontal frame portions in the downstream portion 34 is lower than that in the upstream portion 36.

(H05) In the above described example, the downstream end of the downstream portion 34 may be disposed downstream of the upstream end of the inclined surface 2*b*. However, the downstream end of the downstream portion 34 may be disposed upstream of the upstream end of the inclined surface 2*b*.

(H06) In the above described example, the transport ability of the downstream portion 34 may be lower than the transport ability of the upstream portion 36, but the upstream portion 36 and the downstream portion 34 may be made to have the same transport ability.

(H07) In the above described example, regarding the agitation unit 32, a distance between the connecting portion S1*c* and the rotation center S1*a*, a distance between the connecting portion S1*c* and the first guide projection 32*b*, a distance between the first guide projection 32*b* and the transport connection portion 32*d*, and a distance between the connecting portion S1*c* and the pushing portion 32*c* may be arbitrarily changed in accordance with a design and specification. Further, when the distance between the first guide projection 32*b* and the transport connection portion 32*d* is decreased, the connection portion trajectory T4 becomes a more flat elliptical trajectory than the trajectory described in Example 1. That is, it is possible to further narrow a space at an upper side while securing a distance by which the transport unit 33 reciprocally moves. In addition, when the distance between the connecting portion S1*c* and the pushing portion 32*c* is increased, the inner diameter of the pushing trajectory T3 is increased, and as a result, it is possible to strengthen the force for pushing the developer. Further, as the distance between the connecting portion S1*c* and the rotation center S1*a* is increased, it is possible to further horizontally increase the transport trajectory T6 of the tip end 38*d*, and thus to improve the transport performance.

(H08) In the above described example, regarding the transport unit 33, a distance between the transport connection portion 32*d* and the position regulating projection 34*b* and a distance between the position regulating projection 34*b* and the tip end 38*a* may be changed arbitrarily in accordance with a design and specification. Further, when a ratio of the distance between the position regulating projection 34*b* and the tip end 38*a* to the distance between the transport connection portion 32*d* and the position regulating projection 34*b* is decreased, the transport trajectory T6 of the tip end 38*a* is horizontally elongated, and as a result, it is possible to further narrow a space at the upper side.

(H09) In the above described example, a configuration is exemplified in which the guide grooves 12 and 14 as an example of a regulating portion are formed in the cleaner container 1, and the projections 32*b* and 34*b* as an example of a regulated member are formed on the transport member 31, but the present invention is not limited thereto. For example, it is also possible to form the projection in the cleaner container 1 and to form the groove in the transport member 31. In addition, at one end side in a sheet width direction, the projection may be formed in the cleaner container 1, and the groove may be formed in the transport member 31, and at the other end side in the sheet width direction, the groove may be formed in the cleaner container 1, and the projection may be formed on the transport member 31.

(H010) In the above described example, the pushing portion 32*c* may have any shape as long as the developer can be leveled without being limited to the illustrated shape. Further, although it is desirable to provide the pushing portion 32*c*, a configuration may be made in such a manner that no pushing portion is provided.

(H011) In the above described example, the crank shaft S1 is exemplified as an example of a shaft member, but the shaft member may also be configured as a non-eccentric rotating shaft.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaner comprising:

a cleaning blade configured to remove a developer from a surface of an image carrier;

an accommodating container configured to accommodate the removed developer; and a transport member configured to transport the developer removed by the cleaning blade to the accommodating container, wherein the transport member comprises;

a shaft extending in a direction intersecting a transport direction of the developer;

a first arm rotatably supported by the shaft, and a second arm that is rotatably supported by the first arm at a position spaced from the shaft and that extends toward the cleaning blade;

wherein the transport member is configured such that, when the shaft rotates, a trajectory of an end, at a cleaning blade side, of the second arm is an ellipse elongated along the transport direction of the developer on the cleaning blade, and wherein the cleaner further comprises:

a first projection disposed between the shaft and a connector assembly that rotatably supports the second arm in the first arm, the first projection being supported by a first groove provide on a main body of the cleaner; and a second projection disposed between the connector assembly and an end, at a cleaning blade side, in the second arm, the second projection being supported by a second groove provided on the main body of the cleaner.

2. The cleaner according to claim 1, wherein the first groove is configured to guide the first projection such that a trajectory of the connector assembly is an ellipse elongated along the transport direction of the developer on the cleaning blade.

3. The cleaner according to claim 2, wherein the first groove is configured to guide the first projection along the transport direction of the developer on the cleaning blade, and wherein the second groove is configured to guide the second projection along the transport direction of the developer on the cleaning blade.

4. The cleaner according to claim 2, further comprising:

a cleaning blade support arm that supports the cleaning blade, wherein the connector assembly is disposed such that the trajectory of the connector assembly is located downstream of the cleaning blade support arm in the transport direction of the developer on the cleaning blade.

5. The cleaner according to claim 2, further comprising:

a pushing portion disposed opposite to the connector assembly that rotatably supports the second arm across the shaft, the pushing portion being configured to push the developer toward the accommodating container.

6. The cleaner according to claim 2, wherein the shaft comprises:

a rotation center; and an eccentric portion that is eccentric from the rotation center, the eccentric portion rotatably supporting the first arm.

7. The cleaner according to claim 1, wherein the first groove is configured to guide the first projection along the transport direction of the developer on the cleaning blade, and wherein the second groove is configured to guide the second projection along the transport direction of the developer on the cleaning blade.

8. The cleaner according to claim 7, further comprising:

a cleaning blade support arm that supports the cleaning blade, wherein the connector assembly is disposed such that a trajectory of the connector assembly is located downstream of the cleaning blade support arm in the transport direction of the developer on the cleaning blade.

9. The cleaner according to claim 7, further comprising:

a pushing portion disposed opposite to the connector assembly that rotatably supports the second arm across the shaft, the pushing portion being configured to push the developer toward the accommodating container.

10. The cleaner according to claim 7, wherein the shaft comprises:

a rotation center; and an eccentric portion that is eccentric from the rotation center, the eccentric portion rotatably supporting the first arm.

11. The cleaner according to claim 1, further comprising:

a cleaning blade support arm that supports the cleaning blade, wherein the connector assembly is disposed such that a trajectory of the connector assembly is located downstream of the cleaning blade support arm in the transport direction of the developer on the cleaning blade.

12. The cleaner according to claim 11, further comprising:

a pushing portion disposed opposite to the connector assembly that rotatably supports the second arm across the shaft, the pushing portion being configured to push the developer toward the accommodating container.

13. The cleaner according to claim 11, wherein the shaft comprises:

a rotation center; and an eccentric portion that is eccentric from the rotation center, the eccentric portion rotatably supporting the first arm.

14. The cleaner according to claim 1, further comprising:

a pushing portion disposed opposite to the connector assembly that rotatably supports the second arm across the shaft, the pushing portion being configured to push the developer toward the accommodating container.

15. The cleaner according to claim 14, wherein the shaft comprises:

a rotation center; and an eccentric portion that is eccentric from the rotation center, the eccentric portion rotatably supporting the first arm.

16. An image forming apparatus comprising:

a photoconductor;

a light configured to form a latent image on the photoconductor;

a developing device configured to develop the latent image of the photoconductor into a visible image;

a transfer roller configured to transfer the visible image of the photoconductor to a medium; and the cleaner according to claim 1 configured to remove the developer from a surface of the photoconductor after the visible image is transferred.

17. A cleaner comprising:

a cleaning blade configured to remove a developer from a surface of an image carrier;

an accommodating container configured to accommodate the removed developer; and a transport member configured to transport the developer removed by the cleaning blade to the accommodating container, wherein the transport member comprises:

a shaft extending in a direction intersecting a transport direction of the developer;

a first arm rotatably supported by the shaft; and a second arm that is rotatably supported by the first arm at a position spaced from the shaft and that extends toward the cleaning blade, wherein the transport member is configured such that, when the shaft rotates, a trajectory of an end, at a cleaning blade side, of the second arm is an ellipse elongated along the transport direction of the developer on the cleaning blade, and wherein the shaft comprises:

a rotation center; and an eccentric portion that is eccentric from the rotation center, the eccentric portion rotatably supporting the first arm.

* * * * *